US005521805A

United States Patent [19]

Lim

[11] Patent Number: 5,521,805

[45] Date of Patent: May 28, 1996

[54] FLUORESCENT LAMP

[76] Inventor: Young G. Lim, 479-12, Amsa-1 Dong, Kangdong-ku, Seoul, Rep. of Korea

[21] Appl. No.: 102,559

[22] Filed: Aug. 5, 1993

[51] Int. Cl.[6] ..... F21S 3/00

[52] U.S. Cl. ..... 362/221; 362/217; 362/219; 439/235

[58] Field of Search ..... 362/217, 219, 362/221, 225, 260; 439/226, 228, 235, 236, 242, 541, 547, 554

[56] References Cited

U.S. PATENT DOCUMENTS

| | | | |
|---|---|---|---|
| 3,070,689 | 12/1962 | McIntosh | 362/219 |
| 3,514,590 | 5/1970 | Shaeffer | 362/221 |
| 4,092,562 | 5/1978 | Campbell | 439/235 |
| 4,130,860 | 12/1978 | Careglio et al. | 362/221 |
| 4,907,138 | 3/1990 | Brueggemann et al. | 362/260 |

FOREIGN PATENT DOCUMENTS

| | | | |
|---|---|---|---|
| 4028461 | 3/1992 | Germany | 362/217 |
| 1480295 | 7/1977 | United Kingdom | 362/217 |
| 2225100 | 5/1990 | United Kingdom | 362/260 |

*Primary Examiner*—Ira S. Lazarus
*Assistant Examiner*—Y. Quach

[57] ABSTRACT

A fluorescent lamp has a simple construction that makes assembly convenient, improves productivity, and makes convenient connecting a plurality of fluorescent lamps. The fluorescent lamp has an elongated body, a pair of caps slidably coupled to opposite ends of the body, a pair of terminal members slidably coupled to the caps, a circuit board disposed over the body and connected at its opposite ends with the connecting terminal members, a pair of lead wires connected with the circuit board, a lamp adhering at its opposite ends to the caps, and a cover coupled to upper portions of the caps and body.

7 Claims, 3 Drawing Sheets

FLUORESCENT LAMP

BACKGROUND OF THE INVENTION

The present invention relates to fluorescent lamps, and more particularly to an improvement of the fluorescent lamp disclosed in Korean Utility Model Application No. 92-13089, filed Jul. 15, 1992 by applicant, having a facilitated assembly and providing convenient connection of multiple lamps.

Fluorescent lamps are a type of electric lighting fixture suitable for indoor or outdoor use. Recently, fluorescent lamps have been installed for ornamental purposes in showcases or showrooms (to provide visual effects) in addition to simply illuminating a space. To maximize the ornamental effect, fluorescent lamps are designed in various slim shapes.

The fluorescent lamp disclosed in Korean Utility Model Application No. 92-13089 has a compact and laminate construction for minimizing space occupied and thus maximizing the utilization of subsidiary spaces. Unfortunately, this fluorescent lamp is complex in construction, resulting in a poor workability in assembling and thereby a degradation in productivity. Moreover, the number of constituting elements are increased, thereby increasing the cost of manufacture.

SUMMARY OF THE INVENTION

An object of the invention is to solve the above-mentioned problems and thus to provide a fluorescent lamp with a construction amicable to convenient assembly and thus improved productivity.

Another object of the invention is to provide a fluorescent lamp construction that conveniently connects a plurality of lamps in series without separate adapters.

These objects may be accomplished by providing a fluorescent lamp comprising: a body; a pair of caps slidably coupled to opposite ends of said body, each of the caps having an opened outer end; a pair of connecting terminal members slidably coupled to the caps, respectively, the connecting terminal members having a receptacle and a plug, respectively; a circuit board disposed over an upper portion of the body between the caps and connected at its opposite ends with the connecting terminal members, respectively; a pair of lead wires extending in the body, each of said lead wires being connected at one end thereof with one side portion of the circuit board and at the other end thereof with the other side portion of the circuit board; a lamp adhering at its opposite ends to the caps, respectively, said lamp being connected with the circuit board by a pair of power supply leads disposed in the body; and a cover coupled to upper portions of the caps and body and adapted to protect the circuit board.

DETAILED DESCRIPTION OF THE INVENTION

The subject invention will now be described in terms of its preferred embodiments. These embodiments are set forth to aid in the understanding of the invention, but are not to be construed as limiting.

Figure 1:
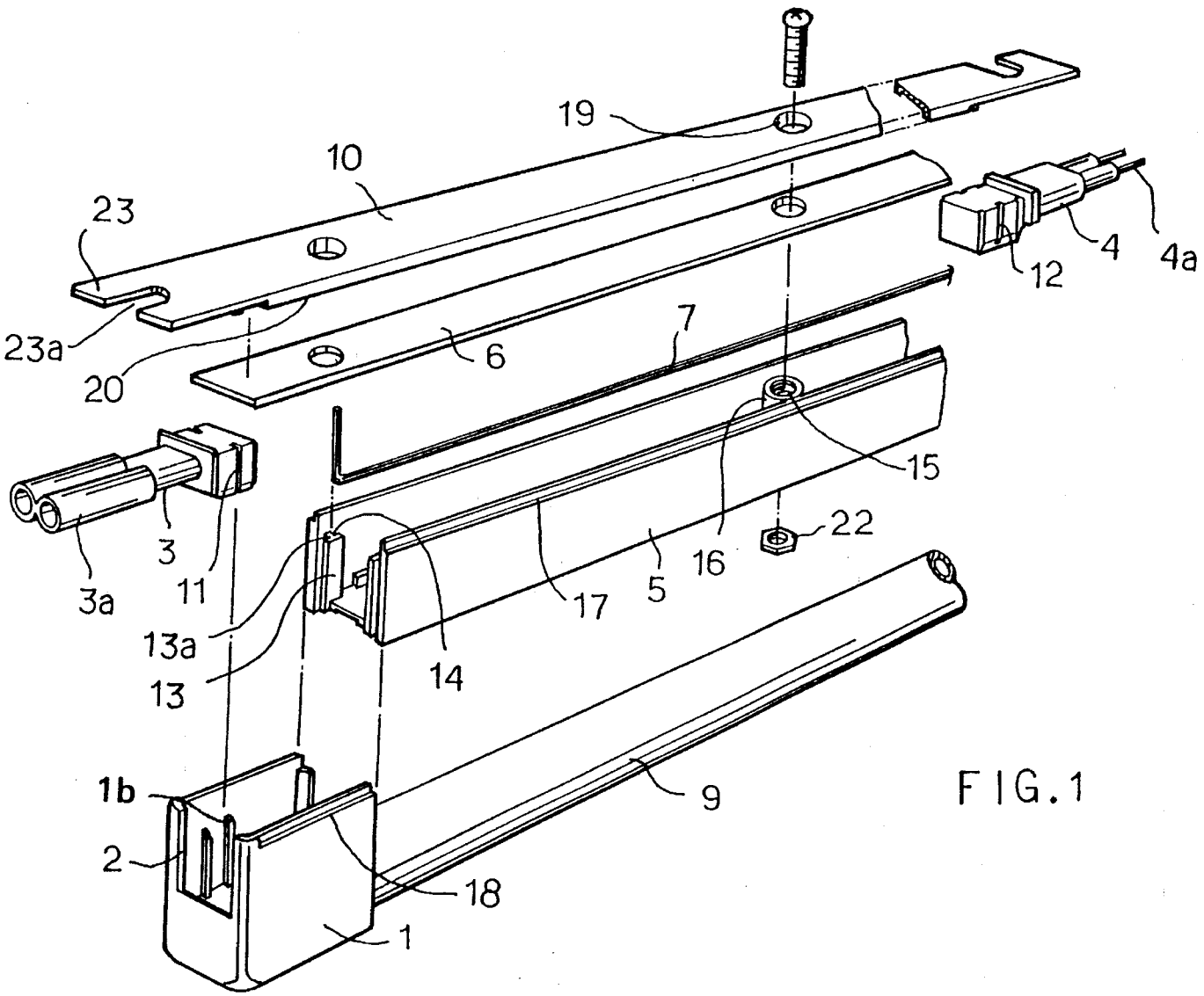
FIG. 1—An exploded perspective view of a fluorescent lamp of the present invention.
Figure 2:
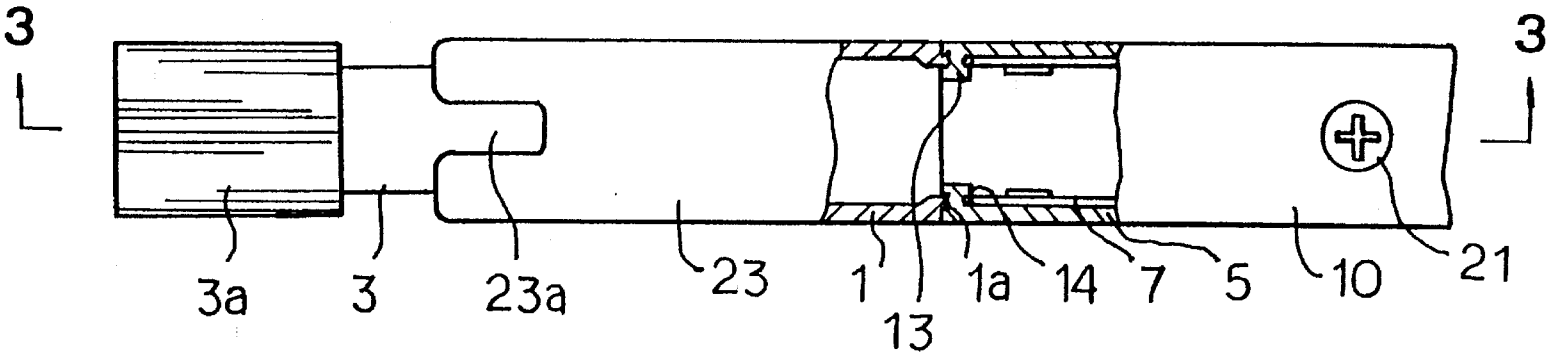
FIG. 2—A partially broken-out plan view of a portion of the fluorescent lamp.
Figure 3:
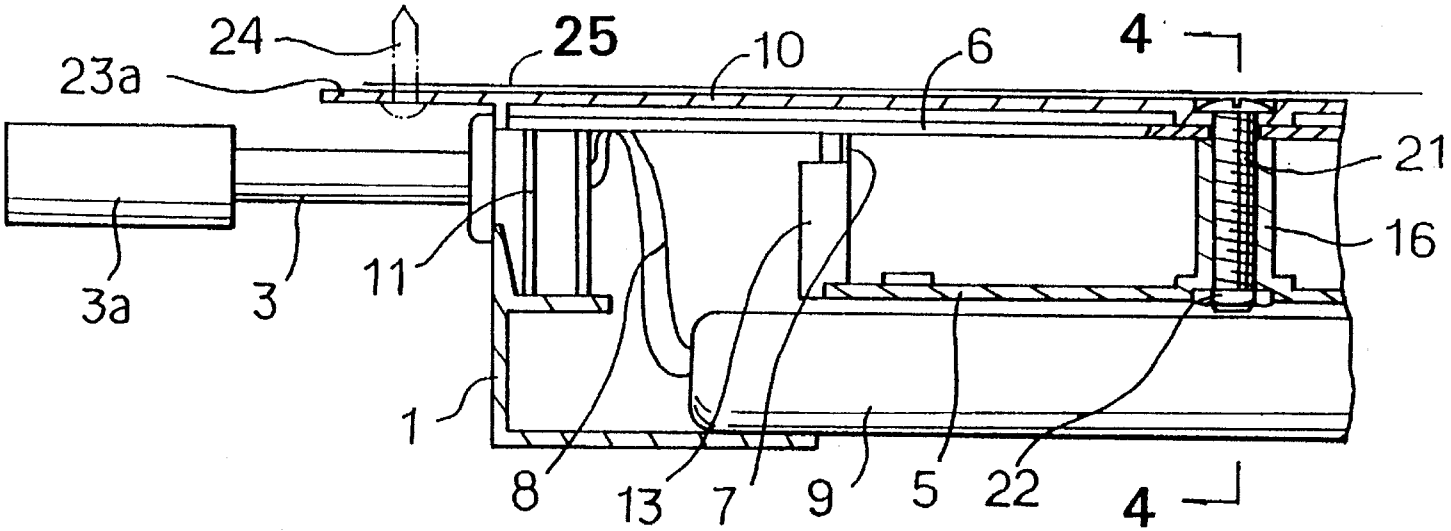
FIG. 3—A cross-sectional view taken along the line 3—3 of FIG. 2.
Figure 4:
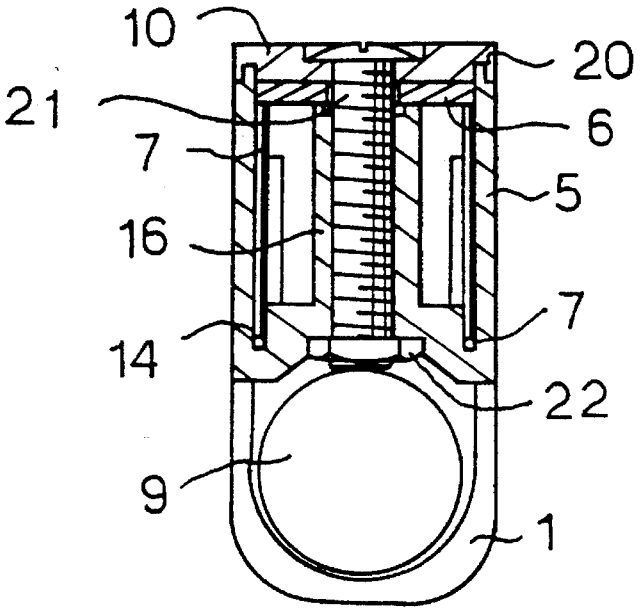
FIG. 4—A cross-sectional view taken along the line 4—4 of FIG. 3.
Figure 5:
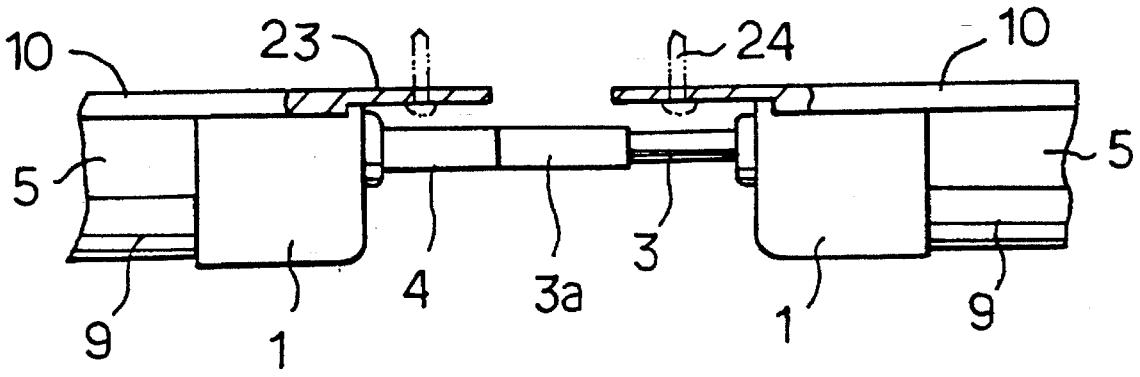
FIG. 5—A front view illustrating the fluorescent lamp in use.

FIGS. 1 to 5 illustrate an embodiment of the subject fluorescent lamp. FIG. 1 is an exploded perspective view of the fluorescent lamp. FIG. 2 is a partially broken-out plan view of the fluorescent lamp. FIG. 3 is a cross-sectional view taken along the line 3—3 of FIG. 2. FIG. 4 is a cross-sectional view taken along the line 4—4 of FIG. 3. Finally, FIG. 5 is a front view illustrating the using condition of the fluorescent lamp.

The fluorescent lamp comprises a body 5 having opposite ends to which a pair of caps 1 are slidably fitted. Each of the caps 1 has an opened outer end 2. Slidably mounted to one of the caps is a first connecting terminal member 3 having a receptacle 3*a*. To the other cap 1, a second connecting terminal member 4 is slidably mounted. Second connecting terminal member 4 includes a plug 4*a*. A circuit board 6 is disposed over the upper portion of body 5 between caps 1, and is connected at its opposite ends with the first and second connecting terminal members 3 and 4, respectively. In body 5, a pair of lead wires 7 extend, each of which is electrically connected at one end with one side portion of circuit board 6 and at the other end with the other side portion of circuit board 6. Beneath body 5, lamp 9 adheres at its opposite ends to caps 1 and is connected with circuit board 6 by means of a pair of power supply leads 8. Cover 10 is coupled to the upper portions of caps 1 and body 5, so as to protect circuit board 6.

For slidably coupling each cap 1 with first and second connecting terminal members 3 and 4 respectively, each cap 1 has an opened outer end 2 and ribs 1*b* displaced a distance from the open outer end 2, whereas each connecting terminal member has a pair of grooves 11 and 12 respectively, for receiving a corresponding rib 1*b*.

For slidably coupling each cap 1 and body 5 with each other, each cap 1 has at its inner end a pair of guide rails 1*a*, whereas body 5 is provided at its opposite ends with a pair of ribs 13 each having a pair of guide grooves 13*a* for receiving a corresponding guide rail 1*a*.

For holding lead wires 7 in body 5, wire receiving grooves 14 are provided, each of which is defined between an inner corner portion of each rib 13 and each corresponding corner portion of body 5.

For coupling cover 10 to body 5, a plurality of bosses 16 are provided in body 5, each of which has a lower bolt guide hole 15. Also, a pair of elongated steps 17 are formed at upper ends of body 5. Each cap 1 also has a pair of elongated steps 18 at its upper ends. Cover 10 has a plurality of upper bolt guide holes 19 and a pair of elongated protrusions 20. The coupling between the cover 10, body 5 and caps 1 is accomplished by engaging protrusions 20 with steps 17 and 18 of body 5 and caps 1, such that the lower bolt guide holes 15 of body 5 and the upper bolt guide holes 19 of cover 10 are aligned respectively, inserting bolts 21 into the aligned bolt guide holes 19 and 15 and then fastening nuts 22 to threaded ends of the bolts 21.

At opposite ends of cover 10, a pair of mounting members 23 each having a groove 23*a* are provided. Accordingly, cover 10 can be supported on a wall, by means of screws 24 fixedly mounted to the wall and engaged with grooves 23*a* of mounting members Assembling procedure of the fluorescent lamp with the above-mentioned construction will now be described.

First, first connecting terminal member 3 (with receptacle 3*a*) is connected to one side portion of the circuit board 6. Second connecting terminal member 4 (with plug 4*a*) is connected to the other side portion of circuit board 6. Thereafter, each lead wire 7 is disposed in body 5 such that its opposite ends are engaged in grooves 14 each defined between the inner corner portion of each rib 13 and each corresponding corner portion of the body 5.

Caps 1 are then coupled to body 5 by fitting guide rails 1*a* of caps 1 in the guide grooves 13*a* of ribs 13 formed at opposite ends of body 5.

In this condition, a pair of grooves 11 provided at first connecting terminal member 3 are engaged with ribs 1*b* of one of caps 1. The pair of grooves 12 of second connecting terminal member 4 is engaged with ribs 16 of other cap 1. Accordingly, connecting terminal members 3 and 4 are slidably coupled to both caps 1. At this time, circuit board 6 is disposed in the upper portion of body 5 and connected with lead wires 7 disposed in body 5, by the worker.

Subsequently, opposite ends of lamp 9 adhere to caps 1. Lamp 9 is connected to circuit board 6 by means of power supply leads 8. Finally, cover 10 is coupled to the upper portions of body 5 and caps 1. Thus, completing assembly of the fluorescent lamp.

When the upper portions of body 5 and caps 1 are covered with cover 10, a pair of protrusions 20 provided at cover 10 are engaged with a pair of steps 17 formed at the upper portions of body 5, and a pair of steps 18 formed at the upper portions of caps 1, respectively. Then, the worker inserts bolts 21 into upper bolt guide holes 19 of cover 10, and lower bolt guide holes 15 formed in the bosses 16 of body 5 and the holes formed in the circuit board are aligned with upper bolt guide holes 19. The worker then fastens nuts 22 to the threaded ends of bolts 21. As a result, body 5, circuit board 6 and cover 10 are assembled integrally with one another, so that circuit board 6 is completely protected.

After assembly, the fluorescent lamp can be used by affixing it to a ceiling or wall 25. The fixture of the fluorescent lamp is achieved by fixing screws 24 to the wall and then passing them through grooves 23*a* of mounting members 23, so as to fixedly mount cover 10 to the wall.

As a power supply plug (not shown) is coupled to the receptacle 3*a* of first connecting terminal member 3, under the fixed state of fluorescent lamp, electric power is supplied to one side portion of the circuit board 6 via first connecting terminal member 3 and then to the outer side portion of circuit board 6 via lead wires 7. At this time, the electric power supplied to circuit board 6 is also supplied to lamp 9 adhering at its opposite ends to the caps 1. Lamp 9 is electrically connected to both side portions of circuit board 6, via power supply leads 8.

Although the assembly procedure has been described for one fluorescent lamp, a plurality of fluorescent lamps connected in series may be used. In this case, the connection between adjacent fluorescent lamps is achieved by coupling plug 4*a* of second connecting terminal member 4 of one fluorescent lamp to receptacle 3*a* of first connecting terminal member 3 of the other fluorescent lamp.

Although the preferred embodiments of the invention have been disclosed for illustrative purposes, those skilled in the art will appreciate that various modifications, additions and substitutions are possible, without departing from the scope and spirit of the invention as disclosed in the accompanying claims. Thus, the invention is only to be limited by the claims that follow and their equivalents.

What is claimed is:

1. A fluorescent lamp comprising: a body having an interior portion; a pair of caps slidably coupled to opposite ends of the body, each of the caps having an open outer end; a pair of connecting terminal members each slidably coupled with one of the caps, one of the connecting terminal members having a receptacle the other connecting terminal member having a plug; a circuit board disposed within an upper portion of the body between the caps, each of its opposite ends connected with one of the connecting terminal members; a pair of lead wires extending into the body, each of the lead wires being electrically connected at one end with one side portion of the circuit board and at the other end with the other side portion of the circuit board; a lamp adhering at its opposite ends to the caps, the lamp being connected with the circuit board by a pair of power supply leads disposed within the body; and a cover coupled to upper portions of the caps and body, and adapted to protect the circuit board.

2. A fluorescent lamp of claim 1, wherein each of the caps is provided with a pair of ribs inwardly displaced from the open outer end of each cap and each of the connecting terminal members has a pair of grooves for receiving the corresponding pair of ribs, so as to be slidably coupled to the cap.

3. A fluorescent lamp of claim 1, wherein each of the caps is provided at its inner end with a pair of guide rails and at each end of the body is provided ribs with a pair of ribs each pair of ribs having a pair of guide grooves for receiving corresponding one of the guide rails, so that each cap and the body are slidably couplable to each other.

4. A fluorescent lamp of claim 3, wherein a wire receiving groove is defined between an inner corner portion of each of the ribs and an adjacent portion of the body, the wire receiving groove being adapted to receive an end of each of the lead wires.

5. A fluorescent lamp of claim 1, wherein the body is provided at the interior thereof with a plurality of bosses each having a bolt guide hole and at upper ends thereof with a pair of steps, each of the caps is provided at the upper ends thereof with a pair of steps, and the cover has a plurality of bolt guide holes, each of the bolt guide holes of the cover to be aligned with each corresponding bolt guide hole of the body and a pair of protrusions each adapted to be engaged with both each corresponding one of said steps of the body and each corresponding one of said steps of each cap, so that the cover is coupled to both the body and each cap by inserting bolts into the aligned bolt guide holes and then fastening with fastening nuts to threaded ends of the bolts.

6. A fluorescent lamp of claim 5, wherein the cover is provided at opposite ends thereof with a pair of mounting members each having a groove adapted to receive a screw adapted to be fixedly mounted to a wall.

7. A fluorescent lamp of claim 1, wherein the cover is provided at opposite ends thereof with a pair of mounting members each having a groove adapted to receive a screw adapted to be fixedly mounted to a wall.

* * * * *